US011458727B2

(12) United States Patent
Kondo

(10) Patent No.: US 11,458,727 B2
(45) Date of Patent: Oct. 4, 2022

(54) PRINTER

(71) Applicant: BROTHER KOGYO KABUSHIKI KAISHA, Nagoya (JP)

(72) Inventor: Hirofumi Kondo, Mie-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 3 days.

(21) Appl. No.: 17/211,206

(22) Filed: Mar. 24, 2021

(65) Prior Publication Data

US 2021/0300033 A1 Sep. 30, 2021

(30) Foreign Application Priority Data

Mar. 27, 2020 (JP) ..... JP2020-057811

(51) Int. Cl.
*B41J 2/045* (2006.01)
*B41J 2/21* (2006.01)
*B41J 25/308* (2006.01)

(52) U.S. Cl.
CPC ..... *B41J 2/04573* (2013.01); *B41J 2/04586* (2013.01); *B41J 2/2117* (2013.01); *B41J 25/308* (2013.01)

(58) Field of Classification Search
CPC .. B41J 2/04573; B41J 2/04586; B41J 2/2117; B41J 25/308
See application file for complete search history.

(56) References Cited

U.S. PATENT DOCUMENTS 7,461,912 B2 * 12/2008 Kamiyama ..... H01L 21/6715 347/19

FOREIGN PATENT DOCUMENTS

JP 2019-014204 A 1/2019

* cited by examiner

*Primary Examiner* — Thinh H Nguyen
(74) *Attorney, Agent, or Firm* — Scully, Scott, Murphy & Presser, PC

(57) ABSTRACT

There is provided a printer including: a carriage; a head; a position sensitive detector having a light-emitter and a light-receiver; and a controller. The head has: a first nozzle from which a printing ink is discharged, and a second nozzle from which a liquid scattering a light emitted from the light-emitter is discharged. The controller is configured to execute: formation of a scattering film on the object by discharging the liquid from the second nozzle onto the object; measurement of a distance between the head and the object, with the light emitted from the light-emitter and irradiated onto the scattering film; and adjustment, based on the measured distance, of a discharging condition of discharging the ink from the first nozzle, and performing printing on the object.

13 Claims, 9 Drawing Sheets

PRINTER

CROSS REFERENCE TO RELATED APPLICATION

The present application claims priority from Japanese Patent Application No. 2020-057811, filed on Mar. 27, 2020, the disclosure of which is incorporated herein by reference in its entirety.

BACKGROUND

Field of the Invention

The present disclosure relates to a printer, in particular, to a printer configured to perform printing on an object having a three-dimensional structure.

Description of the Related Art

Conventionally, there is known a printer which performs printing on a surface of an object having a three-dimensional structure. In a case of performing printing on the object having the three-dimensional structure, it is required, for example, to appropriate set a distance between a head which discharges or ejects an ink and the object, in order to obtain a satisfactory quality of a printed image. In a publicly known image recording apparatus, the above-described distance is measured by using a position sensitive detector (range finding sensor) of the optical system having a light-emitting element and a light-receiving element which received a light emitted from the light-emitting element and reflected off a surface of an object.

SUMMARY

In the above-described publicly known image recording apparatus, however, it is difficult to measure the above-described distance by receiving the light emitted from the light-emitting element and reflected off the surface of the object in a case that the surface of the object is a mirror finished surface or in a case that the object is transparent. Although there is conceived such a measure that uses a position sensitive detector using laser or a position sensitive detector of eddy current system, rather than using the above-described position sensitive sensor, there is a fear that the cost might be increased.

In view of the above-described situation, an object of the present disclosure is to make it possible to obtain a satisfactory image quality with a low cost, in a case that printing is to be performed, by using a printer, on a surface of an object having a three-dimensional shape, and even that the surface of the object is a mirror finished surface or the object is transparent.

According to an aspect of the present disclosure, there is provided a printer including: a carriage configured to move in a scanning direction; a head configured to move in the scanning direction along with the carriage; a position sensor including a light-emitter configured to emit a light toward an object, and a light-receiver configured to receive a reflected light which is the light emitted from the light-emitter and reflected off the object, the position sensor being configured to measure a distance between the head and the object with the reflected light; and a controller. The head includes: a first nozzle from which a first liquid for printing is discharged; and a second nozzle from which a second liquid that is different from the first liquid is discharged. The controller is configured to execute: formation of a scattering film, which is made of the second liquid and is configured to scatter the light emitted from the light emitter, on the object by discharging the second liquid from the second nozzle onto the object, measurement of the distance with the light emitted from the light-emitter and irradiated onto the scattering film, and adjustment, based on the measured distance, of a discharging condition of discharging the first liquid from the first nozzle, and performing of printing on the object.

According to the above-described configuration, in the formation of the scattering film performed prior to the printing, the scattering film which scatters the light from the light-emitter is formed on the object. Accordingly, the light-receiver of the position sensitive detector is capable of appropriately receiving the reflected light reflected by the scattering film. Therefore, the controller is capable of appropriately measuring the distance between the head and the object, with the position sensitive detector. This makes it possible to receive the light stably by the light-receiver even in a case that the surface of the object is a mirror finished surface, or a case that the object is transparent, and to perform the printing in accordance with the above-described distance. Further, by using the position sensitive detector having the light-emitter and the light-receiver, it is possible to measure the above-described distance at a relatively low cost.

As a result, in a case of performing printing on a surface of the object having the three-dimensional shape by using the printer, it is possible to obtain a satisfactory image quality at a low cost, even in a case that the surface of the object is a mirror finished surface or that the object is transparent.

DESCRIPTION OF THE EMBODIMENTS

In the following, respective embodiments of the present disclosure will be explained, with reference to the drawings.

First Embodiment

[Configuration of Image Recording Apparatus]

A printer 1 is capable of performing printing, for example, on a surface of an object W, such as a case of a smartphone, etc., which has a three-dimensional structure. The printer 1 forms a predetermined scattering film 50 (see FIG. 6) on a surface of the object W while the printer 1 is being operated, as will be described later on. Further, the printer 1 measures a distance D (see FIG. 6) between the nozzle surface of the head 23 and the object W by using the scattering film 50 and a position sensitive detector 26. Based on a result of the measurement, the printer 1 is operated in either one mode of a first mode of executing an appropriate printing processing for the object W, and a second mode of performing printing on the object W based on an initial setting condition, regardless of the result of the measurement.

Figure 1:
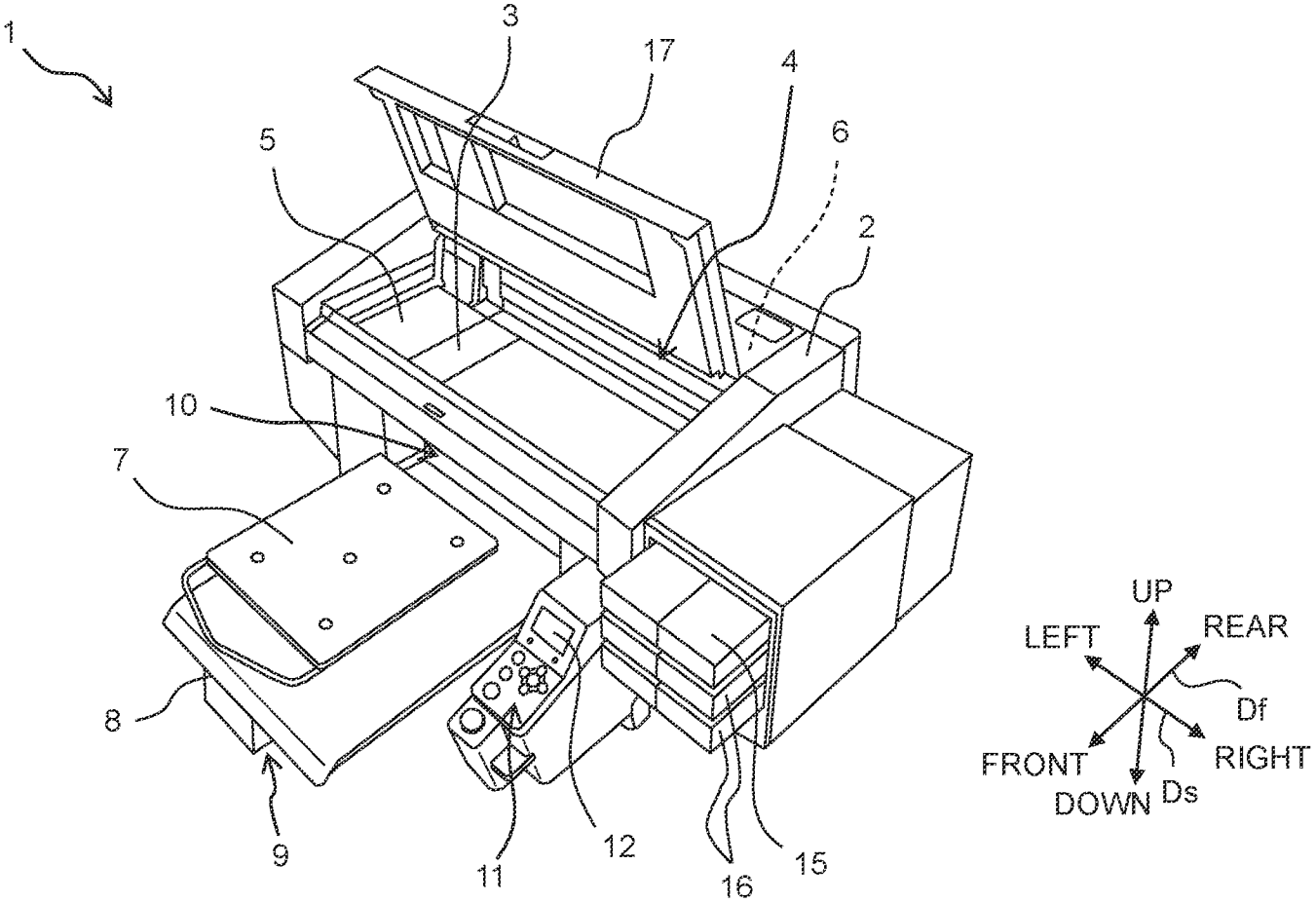
FIG. 1 is a view depicting an outer appearance of a printer related to a first embodiment of the present disclosure.
Figure 2:
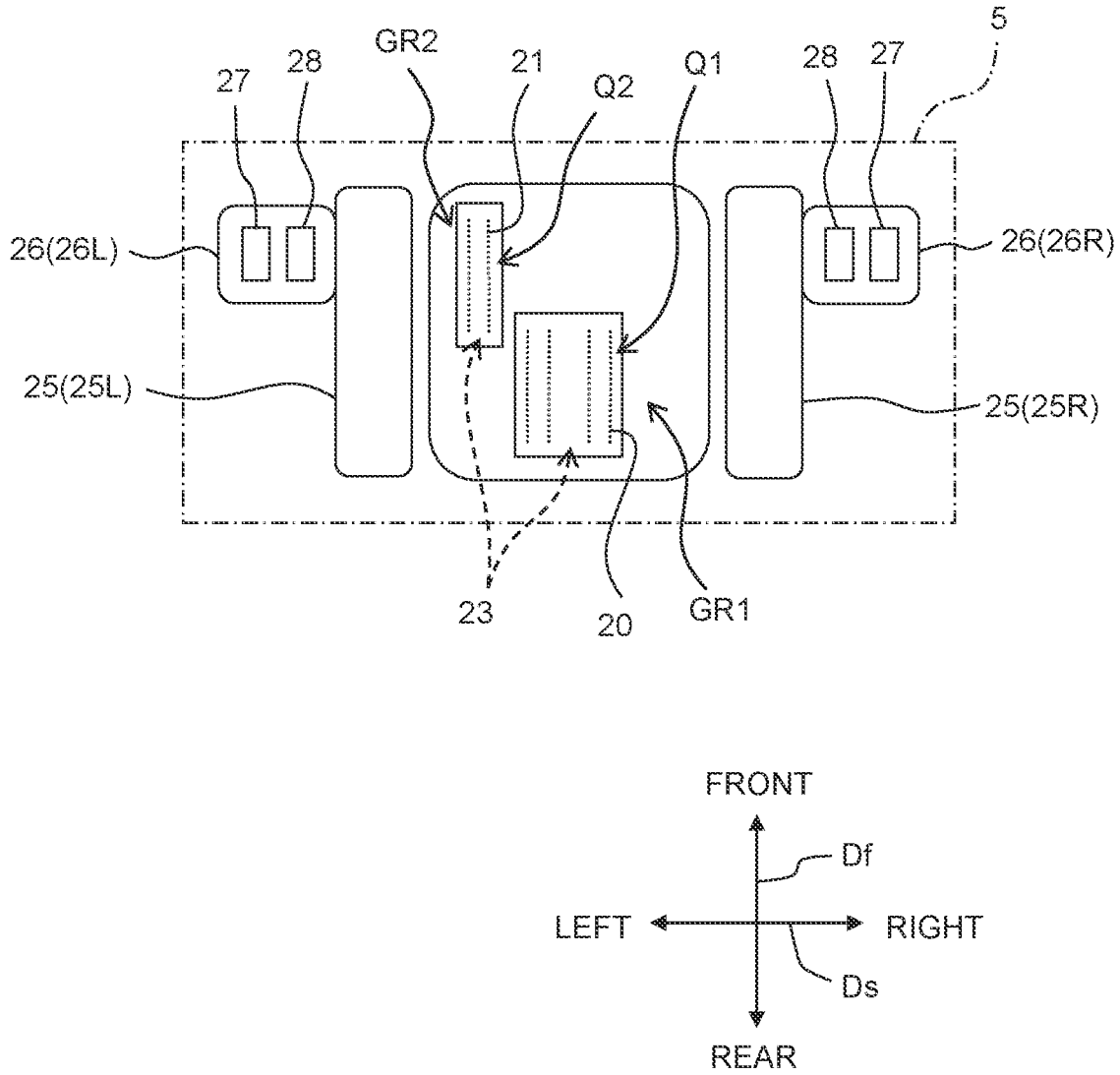
FIG. 2 is a front view of a head of FIG. 1.

As depicted in FIGS. 1 and 2, specifically, the printer 1 includes a casing 2, a carriage 3 arranged to be movable in a predetermined scanning direction (main scanning direction) Ds (as an example, a left-right direction of the printer 1), a carriage moving mechanism 4 configured to cause the carriage 3 to move reciprocally in the scanning direction Ds, a carriage 5 configured to be movable reciprocally in the scanning direction Ds together with the carriage 3, and a controller 6 configured to control the carriage moving mechanism 4 and the head 23.

Further, the printer 1 includes a platen 7 on which the object W is placed, a supporting stand 8 configured to support the platen 7, a supporting stand-moving mechanism 9 configured to cause the platen 7 and the supporting stand 8 to move in a predetermined conveying direction Df which is orthogonal to the scanning direction Ds (here, a sub-scanning direction which is orthogonal to the scanning direction Ds in a plan view of the platen 7), an adjusting mechanism 10 configured to adjust the distance D between the platen 7 and the nozzle surface of the head 23, an operating part 11 configured to be operated by a user and to receive a variety of kinds of requests (for example, switching between the first mode and the second mode, a print job, etc.), and a displaying part 12 configured to display a variety of kinds of information to the user.

Liquid storing parts 15 and 16 are mounted on the casing 2. The liquid storing parts 15 and 16 are connected to the head 23. A liquid is stored in each of the liquid storing parts 15 and 16. The liquid includes, for example, an ink for printing (printing ink) and a scattering film forming liquid. Each of the ink for printing (printing ink) and the scattering film forming liquid includes, as an example, a ultraviolet ray-curable resin. The casing 2 has a cover 17 which is openable/closable and via which an inner part of the casing 2 is accessible from the outside.

The head 23 has a least one first nozzle 20 and at least one second nozzle 21. In the present embodiment, the head 23 has a plurality of first nozzles 20 and a plurality of second nozzles 21. The first nozzle 20 discharges or ejects the printing ink (as an example, an ink of any one of colors which are: C (cyan), M (magenta), Y (yellow) and K (black)). The second nozzle 21 discharges or ejects a liquid causing a light from a light-emitter 27 (to be described later on) to scatter. The printing ink is supplied from the liquid storing part 15 to the first nozzle 20. The liquid causing the light from the light-emitter 27 to scatter is supplied from the liquid storing part 16 to the second nozzle 21.

A plurality of nozzle arrays Q1 and a plurality of nozzle arrays Q2 are formed in the head 23 of the present embodiment. The plurality of nozzle arrays Q1 are arranged side by side in the scanning direction Ds. The plurality of nozzle arrays Q2 are also arranged side by side in the scanning direction Ds. Each of the plurality of nozzle arrays Q1 has the plurality of first nozzles 20 aligned in the conveying direction Df. Further, each of the plurality of nozzle arrays Q2 has the plurality of second nozzles 21 aligned in the conveying direction Df. The head 23 includes a first nozzle group GR1 in which the plurality of first nozzles 20 are arranged in the scanning direction Ds and the conveying direction Df, and a second nozzle group GR2 in which the plurality of second nozzles 21 are arranged in the scanning direction Ds and the conveying direction Df. As an example, in a plan view of the head 23, the first nozzle group GP1 and the second nozzle group GP2 are arranged to be separated from each other in the scanning direction Ds. Furthermore, the second nozzle group GR2 is arranged on the downstream side in the conveying direction Df (here, on the front side) with respect to the first nozzle group GR1.

Moreover, the head 23 has a plurality of piezoelectric elements 23*a* arranged to so as to individually cause the liquid to be discharged from the nozzles 20 and 21, respectively. Each of the plurality of piezoelectric elements 23*a* is individually controlled by the controller 6. As an example, each of the plurality of piezoelectric elements 23*a* is deformed in a case that voltage is applied thereto, and causes the liquid inside one of the nozzles 20 and 21 to be discharged or ejected. In a case that the voltage applied to each of the plurality of piezoelectric elements 23*a* is increased, the deformation of each of the plurality of piezoelectric elements 23*a* becomes great, and a discharge amount of the liquid from one of the nozzles 20, 21 is increased. In a case that the voltage applied to each of the plurality of piezoelectric elements 23*a* is decreased, the deformation of each of the plurality of piezoelectric elements 23*a* becomes small, and the discharge amount of the liquid from one of the nozzles 20, 21 is decreased. Further, a discharging timing (ejecting timing) of the liquid from nozzles 20, 21 corresponding to each of the plurality of piezoelectric elements 23*a* is adjusted by a timing at which the voltage is applied to each of the plurality of piezoelectric elements 23*a*.

At least one UV lamp 25 is mounted on the carriage 5. The at least one UV lamp 25 is configured to cure the ultraviolet ray-curable resin included in the ink discharged from the nozzle 20 or in the liquid discharged from the nozzle 21. In the present embodiment, the UV lamp 25 has a right-side UV lamp 25R and a left-side UV lamp 25L, as a pair of US lamps. The UV lamp 25 is arranged on a side opposite to an advancing side in the scanning direction Ds of the carriage 5, with respect to the nozzles 20 and 21. In a case that the carriage 5 is scanned with the right side in the scanning direction Ds as the advancing side, the left-side UV lamp 25L is located on the upstream side in the scanning direction Ds of the carriage 5, with respect to the nozzles 20 and 21. In a case that the carriage 5 is subjected to the scanning (is scanned) with the left side in the scanning direction Ds as the advancing side, the right-side UV lamp 25R is located on the upstream side in the scanning direction Ds of the carriage 5, with respect to the nozzles 20 and 21.

The UV lamp 25 includes a plurality of UV light sources aligned in the scanning direction Ds and the conveying direction Df. Each of the plurality of UV light sources is, as an example, an LED element. The UV lamp 25 is controlled by the controller 6. Each of the plurality of UV light sources is not limited to the LED element.

Further, at least one position sensitive detector (PSD: Position Sensitive Detector) 26 is arranged on the carriage 5. In the present embodiment, the position sensitive detector 26 (here, as an example, a pair of a right-side position sensitive detector 26R and a left-side position sensitive detector 26L) is arranged to face or to be opposite to the object W placed on the platen 7, and measures a distance (as an example, a minimum distance) D between the nozzle surface of the head 23 and the object W. The position sensitive detector 26 is an optical sensor, and has a light-emitter 27 which emits a light toward the object W, and a light-receiver 28 which receives a reflected light of the light emitted from the light-emitter 27 and reflected off the object W. The position sensitive detector 26 measures the distance D between the nozzle surface of the head 23 and the object W with the above-described reflected light. As an example, the position sensitive detector 26 is of the triangulation system, and is configured to measure the distance D by an incident angle of the reflected light with respect to the light-receiver 28. As such a position sensitive detector 26, it is allowable to use, for example, an infrared position sensitive detector "ORA1M04" (product name) manufactured by KODENSHI CORP.

In a discharge path L0 (see FIG. 4) in which the liquid is discharged from the second nozzle 21 in a going path L1 and a returning path L2 in the scanning direction Ds of the carriage 5, the position sensitive detector 26 is arranged at a position which is on a side opposite to an advancing side in the scanning direction Ds of the carriage 5 in the discharge path L0, with respect to the second nozzles 21. The printing system of the printer 1 of the present embodiment is a bi-directional printing system, and the going path L1 and the returning path L2 are both the discharge path L0. The pair of position sensitive detectors 26 are arranged on the both sides, respectively, in the scanning direction Ds of the second nozzles 21. In a case that the carriage 5 is scanned with the right side in the scanning direction Ds as the advancing side, the left-side position sensitive detector 26L is positioned on the above-described opposite side. In a case that the carriage 5 is scanned with the left side in the scanning direction Ds as the advancing side, the right-side position sensitive detector 26R is positioned on the above-described opposite side.

Figure 3:
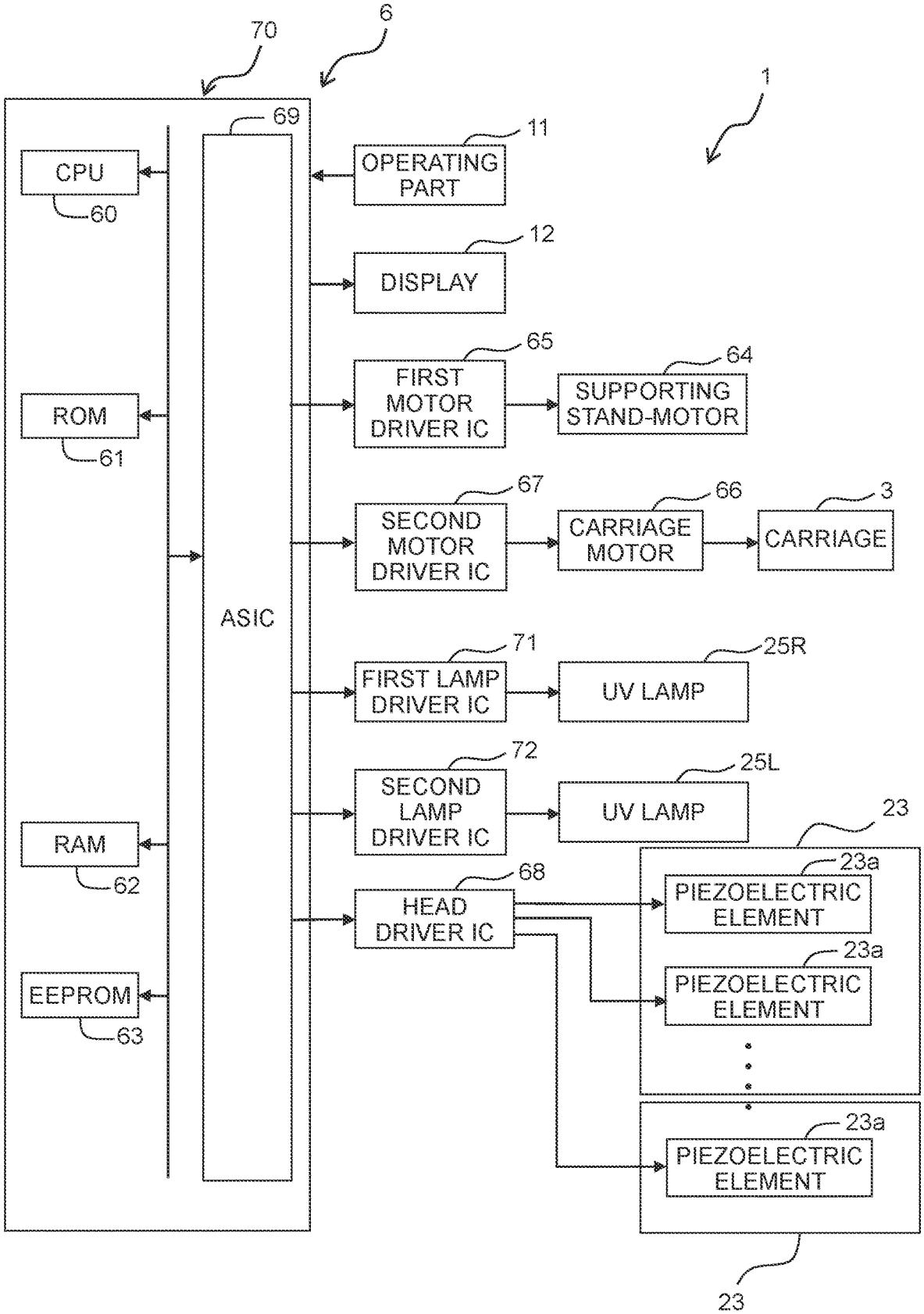
FIG. 3 is a functional block diagram of the printer of FIG. 1.

The controller 6 has an operating part and a storing part (memory). As depicted in FIG. 3, the controller 6 has a CPU 60 as the operating part, and has a ROM 61, a RAM 62 and an EEPROM 63 as the storage part. The number of the CPU 60 possessed by the controller 6 may be either a singular number or plural number. The ROM 61 stores therein a control program with which the CPU 60 executes a predetermined job. The EEPROM 63 stores therein information regarding a variety of kinds of initial setting inputted by a user.

The controller 6 further has an ASIC 69, a first motor driver IC 65 driving a supporting stand-motor 64 as a driving source of the supporting stand-moving mechanism 9, a second motor driver IC 67 driving a carriage motor 66 as a driving source of the carriage 3, and a head driver IC 68 driving the piezoelectric elements 23*a* of the head 23. These driver ICs 65, 67 and 68 are connected to the ASIC 69. Further, the controller 6 has a substrate 70. The CPU 60, the ROM 61, the RAM 62, the EEPROM 63 and the ASIC 69 are mounted on the substrate 70.

The CPU 60 receives an executing request of the print job via the operating part 11 or an external inputting part. The CPU 60 which has received the executing request of the print job outputs an executing command of the print job to the ASIC 69. The ASIC 69 drives each of the respective driver ICs 65, 67 and 68 at a predetermined timing.

As a specific example, the first motor driver IC 65 causes the platen 7 and the supporting stand 8 to move in the conveying direction Df. The second motor driver IC 67 drives the carriage motor 66 to cause the carriage 3 to reciprocally move in the scanning direction Ds. The head driver IC 68 individually controls each of the plurality of piezoelectric elements 23*a* of the head 23, and causes a target nozzle, among the plurality of nozzles 20 and 21, to discharge or eject the liquid. Further, the controller 6 also has a first lamp driver IC 71 driving the UV lamp 25R and a second lamp driver IC 72 driving the UV lamp 25L.

Figure 4:
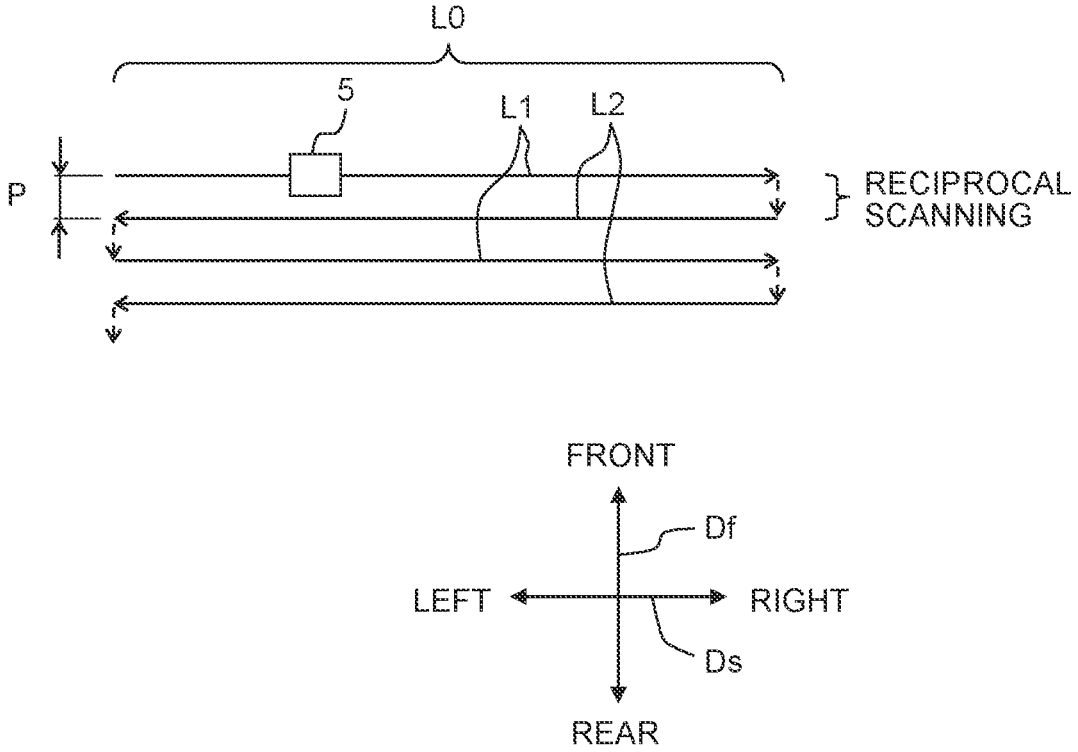
FIG. 4 is a view indicating an operation of the head of the printer, depicted in FIG. 1, during operation.

As depicted in FIG. 4, in a case that the printing is to be performed on the object W by the printer 1, the controller 6 controls the respective driver ICs 65, 67 and 68 in a state that the minimum distance D between the nozzle surface of the head 23 and the object W which is placed on the platen 7 is set to be a predetermined value. With this, the object W is conveyed in the conveyance direction Df, and each of the piezoelectric elements 23*a* is driven at a predetermined timing in a state that the carriage 5 is reciprocally scanned (subjected to the reciprocal scanning) in the discharging path L0 having the going path L1 and the returning path L2, thereby discharging the ink from the first nozzle 20. The printing is performed sequentially with respect to each of areas of the object W, from the upstream side toward the downstream side in the conveying direction Df (as an example, from the front side to the rear side of the printer 1).

[Respective Processings of Image Recording Apparatus]

Next, an explanation will be given about respective processings performed by the printer 1 in a case that the printer 1 is in the first mode. In a case that the printer 1 is set to be in the first mode and that the printer 1 receives a request of a print job from the user, the controller 6 controls the carriage moving mechanism 4 and the head 23 so as to execute a scattering film-forming processing of discharging or ejecting the liquid from the second nozzles 21 onto the object W to thereby form the scattering film 50 (see FIG. 6) on the object W. Next, the controller 6 controls the carriage 5 so as to execute a measuring processing of measuring the distance D by the position sensitive detector 26 that is configured to receive the light emitted from the light-emitter 27, irradiated onto and reflected off the scattering film 50. Then, the controller 6 adjusts a discharging condition of discharging the ink from the second nozzles 21 (hereinafter referred simply also to as "discharging condition"), based on the measured distance D, and controls the carriage moving mechanism 4 and the head 23 so as to execute a printing processing of performing printing on the object W. Note that in the following explanation, the controller 5 controlling the carriage moving mechanism 4 and head 23 so as to execute the scatting film-forming processing and the printing processing is simply expressed as the controller performing the scattering-film forming processing and the printing processing. Similarly, the controller 5 controlling the carriage 5 and the position sensitive detector 26 so as to execute the measuring processing is simply expressed as the controller 6 performing the measuring processing.

The scattering film 50 formed in the scattering film-forming processing scatters (reflects diffusely) the light from the light-emitter 27 of the position sensitive detector 26. Here, provided that an attempt is made to simply measure the distance D between the object W and the nozzle surface of the head 23 by the position sensitive detector 26 in a case that a surface of the object W is, for example, a mirror finished surface, the light from the light-emitter 27 is totally reflected by the object W, and an amount of the scattered light received by the light-receiver 28 is reduced. Further, in a case that the object W is transparent, a part of the light from the light-emitter 27 passes through the object W, and an amount of the scattered light received by the light-receiver 28 is reduced. In either one of these cases, it is difficult to measure the distance D.

In view of the above-described situations, in a case that the scattering film 50 is formed on the surface of the object W, the controller 6 is capable of causing the light from the light-emitter 27 of the position sensitive detector 26 to stably scatter with the scattering film 50. Accordingly, regardless of whether or not the surface of the object W is, for example, the mirror finished surface, or regardless of whether or not the object W is transparent, the controller 6 is capable of obtaining a sufficient amount of the scattered light in the measuring processing by using the position sensitive detector 26. Thus, the controller 6 is capable of appropriately measure the distance D between the object W and the nozzle surface of the head 23, by using the position sensitive detector 26.

In the present embodiment, the liquid discharged from the second nozzles 21 is a white ink. Note that it is allowable that the liquid discharged from the second nozzles 21 is a liquid capable of scattering the light from the light-emitter 27. It is also allowable that the liquid discharged from the second nozzles 21 is a liquid capable of scattering the light from the light-emitter 27 after the liquid has been cured to form a scattering film. For this reason, the liquid may be, for example, an ink of which color is different form white, or a liquid containing fine particles having a light scattering property and a resin which retains the fine particles in a state that the fine particles are dispersed. Further, the scattering film 50 may be a film which is formed uniformly on the surface of the object W, or may be a plurality of films which are arranged dispersively on a surface of the object W. The term "scattering film" in the present specification also encompasses, for example, a configuration wherein each of a plurality of films arranged dispersively on a surface of the object W totally reflects the light from the light-emitter 27 to thereby reflect the light diffusely as a whole.

Distance information, regarding the distance between the nozzle surface of the head 23 and the object W measured in the measuring processing at each of positions in the object W is stored in the storage part by the operating part of the controller 6. In the printing processing, the controller 6 discharges the ink from the second nozzles 21 based on the distance information stored in the storing part to thereby perform printing on the scattering film 50 of the object W. In this situation, the controller 6 adjusts the discharging condition as follows, based on the surface shape of the object W.

Figure 5:
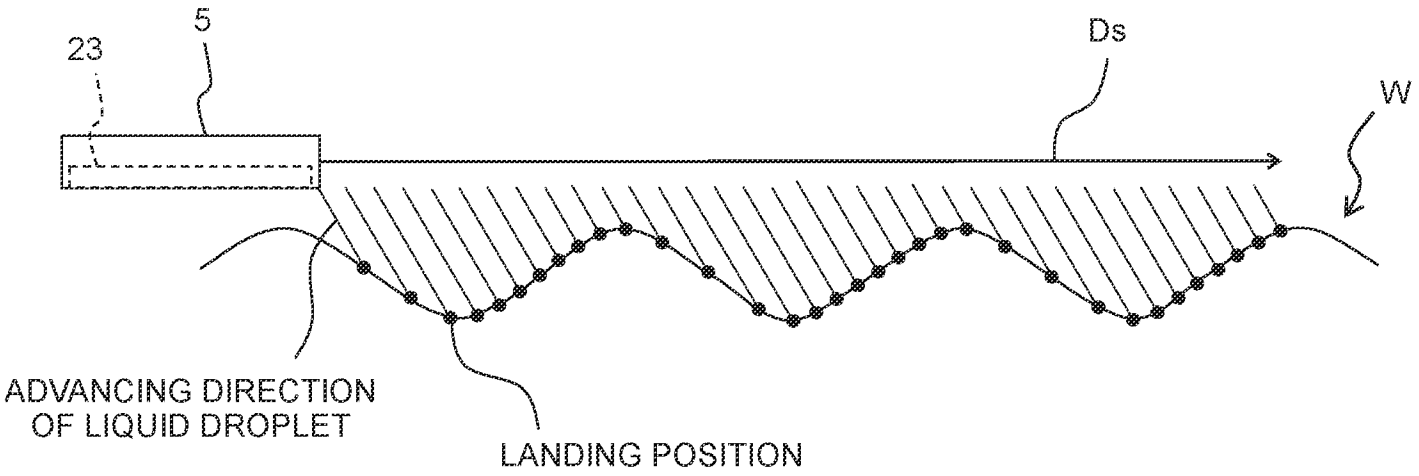
FIG. 5 is a schematic view depicting a conventional printing head during printing and an object.

As depicted in FIG. 5, an advancing direction of a liquid droplet of the ink discharged from each of the nozzles during the scanning is a direction inclined with respect to the scanning direction Ds of the carriage and an axis direction of each of the nozzles of the head, as seen from the conveying direction Df (a direction perpendicular to the sheet surface of FIG. 5). Due to this, in a case of performing printing on an object W in which concavities and convexities are present on a surface thereof, and that the discharging condition is same as a discharging condition for a case of performing printing on an object W of which surface is flat (for example, a condition that the discharging timing of the ink from each of the heads are same), there is such a fear that the droplets of the ink advancing in the inclined direction might land on the surface of the object W at an irregular spacing distance. As a result, each of the liquid droplets of the ink might land on a position deviated from a target portion, thereby lowering the quality of a printed image.

Figure 6:
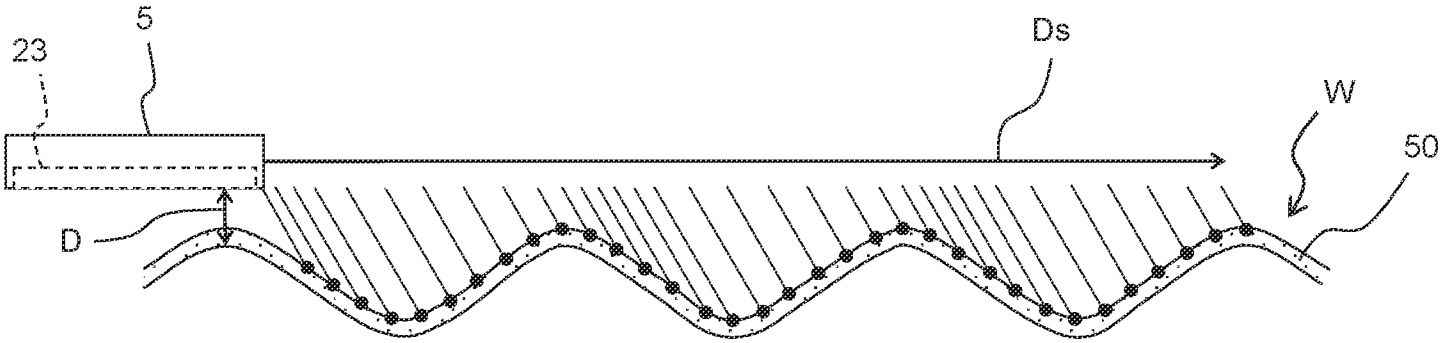
FIG. 6 is a schematic view indicating a printing processing according to the first embodiment.

In view of the above-described situation, in the printing processing of the present embodiment, the controller 6 adjusts, based on the result of the measuring processing, the discharging condition of discharging the link from the first nozzles 20 based on the measured distance D. The discharging condition includes, as an example, a discharging timing at which the ink is to be discharged from each of the first nozzles 20. As depicted in FIG. 6, the controller 6 adjusts the discharging timing of the first nozzle 20 in the head 23 which is being scanned, corresponding to the surface shape of the object W in the scanning direction Ds. With this, the ink from the first nozzles 20 lands on the object W at a target spacing distance.

For example, the controller 6 fastens the discharging timing of the first nozzle 20 in the head 23 which is being scanned at a constant speed. In this case, the landing position of the liquid droplet of the ink from the first nozzle 20 is more likely to move toward the rear side in the advancing direction of the carriage 5. Further, the controller 6 slows the discharging timing of the first nozzle 20 in the head 23 which is being scanned at the constant speed. In this case, the above-described landing position is more likely to move toward the front side in the advancing direction of the carriage 5. By adjusting the discharging timing in such a manner, the advancing direction of the liquid droplet of the ink discharged from the first nozzle 20 is adjusted at each of scanning positions, thereby allowing the liquid droplets of the ink to land on the scattering film 50 of the object W at a predetermined spacing distance (as an example, at a constant spacing distance).

Further, in the printer 1 of the present embodiment, the going path L1 and the returning path L2 in the reciprocal scanning of the carriage 5 in the scanning direction Ds are both the discharge path L0, as depicted in FIG. 4. The controller 6 executes the scattering film-forming processing, the measuring processing and the printing processing with respect to the object W which is being conveyed in the conveying direction Df, at an area, of the object W, located on a scanning line of the head 23, repeatedly at each time the reciprocal scanning of the carriage 5 in the scanning direction Ds is being performed. Furthermore, in the reciprocal scanning of the carriage 5 in the scanning direction Ds, the controller 6 of the present embodiment executes the scattering film-forming processing and the measuring processing during the scanning of the carriage 5 to the going path L1, and executes the printing processing during the scanning of the carriage 5 to the returning path L2. With this, the scattering film-forming processing, the measuring processing and the printing processing are performed efficiently during one time of the reciprocal scanning of the carriage 5.

Note that in order to precisely measure the distance D of an area to be printed of the object W, it is preferred, for example, to form the scattering film 50 in a wide area in the conveying direction Df of the object W, by the scattering film-forming processing, at each time the reciprocal scanning of the carriage 5 in the scanning direction Ds is being performed, and to make a spacing distance of arranging, side by side in the conveying direction Df, measurement areas, of the object W, each of which is subjected to the measurement of the distance D at each time the reciprocal scanning of the carriage 5 in the scanning direction Ds is being performed (in other words, a pitch P of the scanning line), to be made narrow.

As explained above, according to the printer 1, in the scattering film-forming processing performed prior to the printing processing, the scattering film 50 which scatters the light from the light-emitter 27 is formed on the object W. Accordingly, the light-receiver 28 of the position sensitive detector 26 is capable of appropriately receiving the reflected light reflected by the scattering film 50. Therefore, the controller 6 is capable of appropriately measuring the distance D between the nozzle surface of the head 23 and the object W, with the position sensitive detector 26. This makes it possible to receive the light stably by the light-receiver 28 even in a case that the surface of the object W is a mirror finished surface, or a case that the object W is transparent. Further, since the position sensitive detector 26 having the light-emitter 27 and the light-receiver 28 can be obtained at a relatively low price, it is possible to measure the distance D at a relatively low cost.

As a result, it is possible to obtain a satisfactory image quality at a low cost, in a case that printing is to be performed, by using the printer 1, on a surface of an object W having a three-dimensional shape, and even that the surface of the object W is a mirror finished surface or the object W is transparent.

Further, as an example, the position sensitive detector 26 is of the triangulation system, and is configured to measure the distance D by the incident angle of the reflected light with respect to the light-receiver 28. With this, the position sensitive detector 26 is capable of precisely measure the distance D depending on the incident angle of the reflected light, thereby enabling the controller 6 to perform the printing processing appropriately.

Furthermore, in the discharge path L0 in which the liquid is discharged from the second nozzle 21 among the going path L1 and the returning path L2 in the scanning direction Ds of the carriage 5, the position sensitive detector 26 is arranged at the position which is on the side opposite to the advancing side in the scanning direction Ds of the carriage 5 in the discharge path L0. Accordingly, the controller 6 is capable of executing the scattering film-forming processing and the measuring processing in one discharging path L0, and is capable of performing printing efficiently on the object W.

Moreover, in the present embodiment, the going path L1 and the returning path L2 are both the discharge path L0, and the position sensitive detector 26 is provided as the pair of position sensitive detectors 26 on the both sides, respectively, in the scanning direction Ds of the second nozzles 21. Accordingly, in a case that the printer 1 performs the bi-directional printing, it is possible to execute the scattering film-forming processing and the measuring processing in the going path L1 and the returning path L2, thereby making it possible to perform printing further efficiently and appropriately on the object W.

Further, as an example, the controller 6 executes the scattering film-forming processing, the measuring processing and the printing processing with respect to the object W which is being conveyed in the conveying direction Df, at an area, of the object W, located on the scanning line of the head 23, repeatedly at each time the reciprocal scanning of the carriage 5 in the scanning direction Ds is being performed. Accordingly, it is possible to perform printing on the object W sequentially and efficiently from the upstream side toward the downstream side in the conveying direction Ds.

Furthermore, in the reciprocal scanning of the carriage 5 in the scanning direction Ds, the controller 6 of the present embodiment executes the scattering film-forming processing and the measuring processing during the scanning to the going path L1, and executes the printing processing during the scanning to the returning path L2. With this, the printing can be performed efficiently and appropriately at an area, of the object W, located on each of the scanning lines of the head 23, during one time of the reciprocal scanning of the carriage 5.

Moreover, as an example, the second nozzles 21 and the position sensitive detector 26 are arranged on the upstream side in the conveying direction Df (here, on the front side) with respect to the first nozzles 20. Accordingly, for example, in the reciprocal scanning of the carriage 5 in the scanning direction Ds, the controller 6 is allowed to easily execute the scattering film-forming processing and the measuring processing during the scanning of the carriage 5 to the going path L1, and to easily execute the printing processing during the scanning of the carriage 5 to the returning path L2.

Further, the discharging condition of the present embodiment includes the discharging timing at which the ink is to be discharged from each of the first nozzles 20. Accordingly, for example, the controller 6 adjusts an operating timing of each of the actuators configured to discharge the ink from one of the first nozzles 20, thereby making it possible to perform the printing processing with respect to the object W, based on the discharging timing, without using any additional configuration. Furthermore, by using the white ink which is relatively easy to obtain, as the liquid to be discharged from the second nozzles 21, it is possible to reduce the cost regarding the liquid for forming the scattering film 50.

Figure 7:
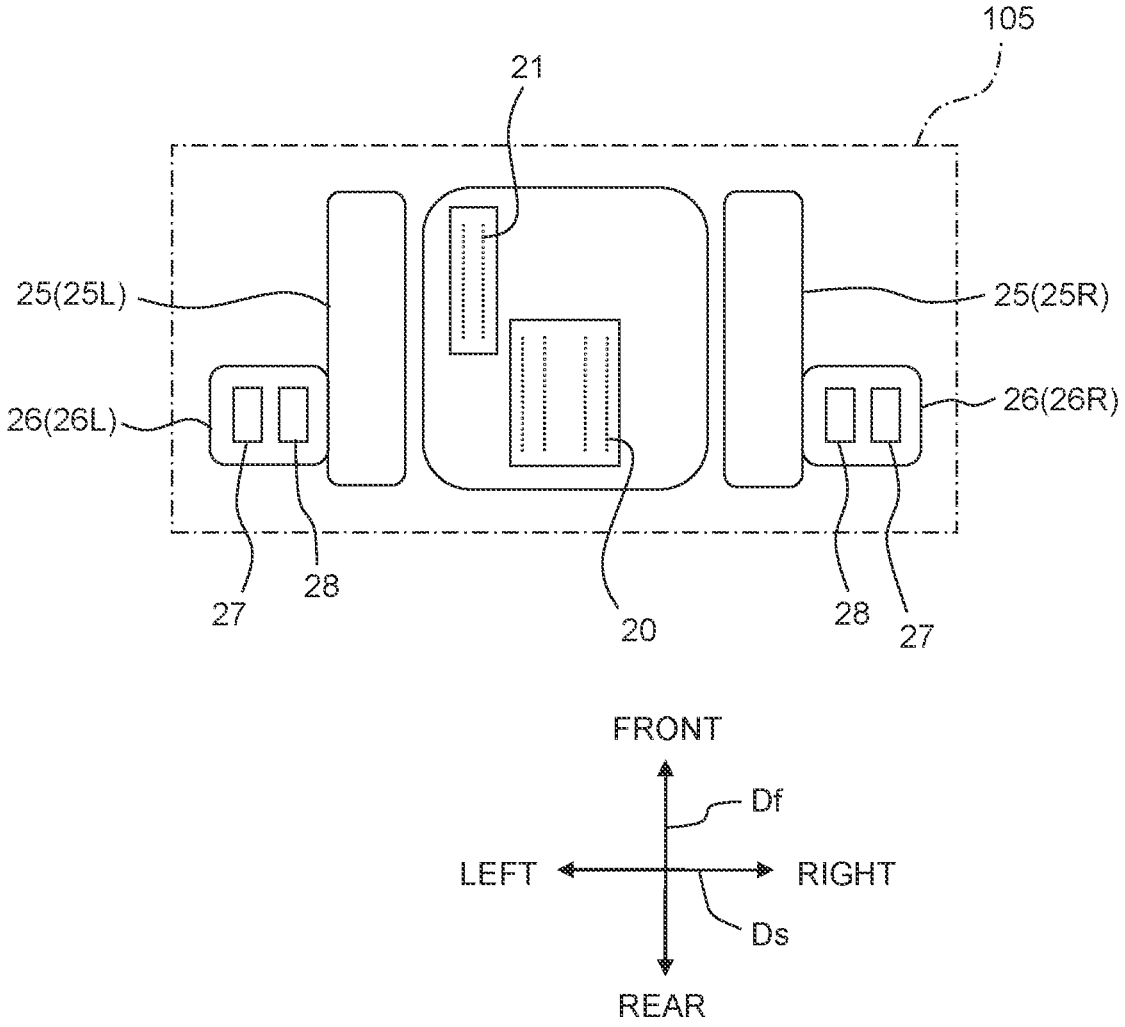
FIG. 7 is a front view of a head according to a modification of the first embodiment.

FIG. 7 is a front view of a carriage 105 according to a modification of the first embodiment. As depicted in FIG. 7, a pair of position sensitive detectors 26 (26R, 26L) are arranged on the carriage 105 on the downstream side in the conveying direction Df (here, on the rear side) with respect to the second nozzles 21, and arranged at the outside in the scanning direction Ds with respect to the first nozzles 20. During the operation of the printer of the present modification, in one time of the reciprocal scanning of the carriage 105, the measuring processing is performed after the scattering film-forming processing and immediately before the printing processing, and the printing processing which is appropriate in accordance with the distance D between the nozzle surface and the object W is performed. With this, an effect similar to that of the first embodiment can be obtained.

Note that the position sensitive detector 26 may be of a photo interrupter system. In such a case, the position sensitive detector 26 measures the distance D with an intensity of the reflected light with respect to the light-receiver 28. Also by using such a position sensitive detector 26, it is possible to obtain an effect similar to that of the case using the position sensitive detector of the triangulation system. Further, it is allowable that the ultraviolet curable resin is not included in the ink and the liquid which are discharged from the nozzles 20 and 21, respectively. In such a case, the UV lamp 25 may be omitted. Furthermore, the printing system of the printer 1 is not limited to or restricted by the bidirectional printing system, and may be a unidirectional printing system. In the following, an explanation will be given about other embodiments, particularly regarding the difference from the first embodiment.

Second Embodiment

In a second embodiment, the discharging condition includes, as an example, a discharging speed at which the ink is discharged or ejected from the first nozzle 20.

Figure 8:
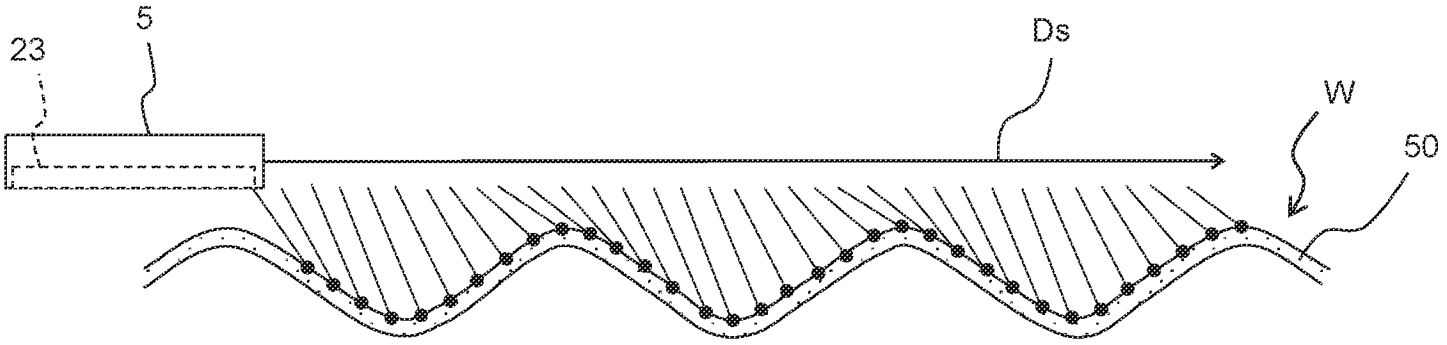
FIG. 8 is a schematic view indicating a printing processing according to a second embodiment.

As depicted in FIG. 8, the controller 6 adjusts the discharging speed of the first nozzle 20 in the head 23 which is being scanned, corresponding to the shape of a surface of the object W in the scanning direction Ds. With this, the ink from the first nozzles 20 lands on the object W, at a target spacing distance. As an example, the controller 6 fastens the discharging speed of the ink from the first nozzle 20 in the head 23 which is being scanned. In this case, the landing position of the liquid droplet of the ink from the first nozzle 20 is more likely to move toward the front side in the advancing direction of the carriage 5. Further, the controller 6 slows the discharging speed of the ink from the first nozzle 20 in the head 23. In this case, the landing position of the liquid droplet of the ink from the first nozzle 20 is more likely to move toward the rear side in the advancing direction of the carriage 5. By adjusting the discharging speed of the ink from the first nozzle 20 in such a manner, the advancing direction of the liquid droplet of the ink discharged from the first nozzle 20 is adjusted at each of scanning positions, thereby allowing the liquid droplets of the ink to land on the scattering film 50 of the object W at a predetermined spacing distance (as an example, at a constant spacing distance). As a result, an effect similar to that in the first embodiment can be obtained.

Further, in the second embodiment, in a case that the plurality of first nozzles 20 are divided into a plurality of groups GP1 and GP2 each of which has one or a plurality pieces of the first nozzle 20, the controller 6 adjusts the discharging speed for each of the groups. With this, the discharging speed of the ink from the first nozzle 20 can be adjusted individually and finely per each of the groups GP1 and GP2, in accordance with the distance (as an example, a minimum distance) between the object W and the first nozzle 20 belonging to each of the groups GP1 and GP2. Accordingly, it is possible to perform a further satisfactory printing processing.

Third Embodiment

In a third embodiment, the discharging condition includes, as an example, a moving speed of the carriage 5 in the scanning direction Ds in the printing processing.

Figure 9:
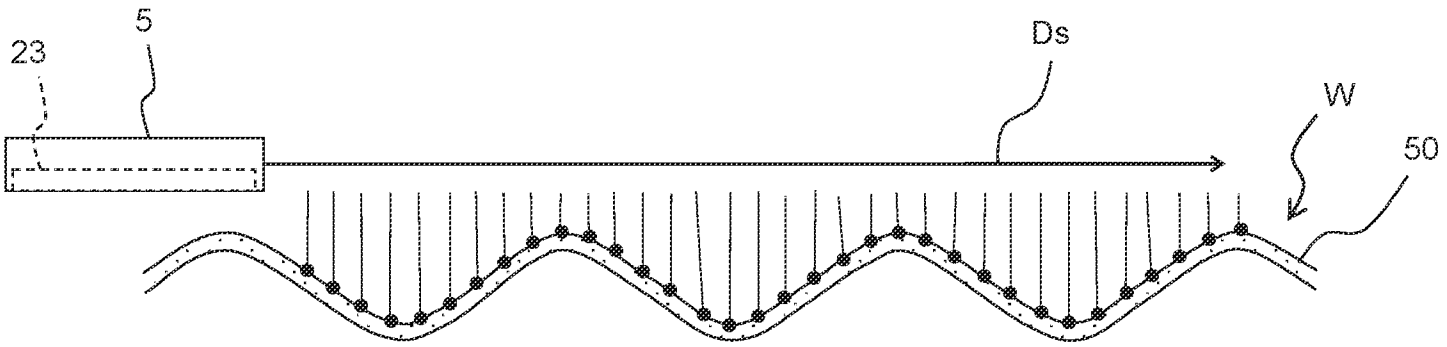
FIG. 9 is a schematic view indicating a printing processing according to a third embodiment.

As depicted in FIG. 9, the controller 6 adjusts the moving speed of the carriage 5 during the scanning (while the carriage 5 is being scanned), corresponding to the shape of a surface of the object W in the scanning direction Ds. With this, the ink from the first nozzles 20 lands on the object W, at a target spacing distance. As an example, the controller 6 fastens the moving speed of the carriage 5. In this case, the landing position of the liquid droplet of the ink from the first nozzle 20 is more likely to move toward the front side in the advancing direction of the carriage 5. Further, the controller slows the moving speed of the carriage 5. In this case, the landing position of the liquid droplet of the ink from the first nozzle 20 is more likely to move toward the rear side in the advancing direction of the carriage 5. By adjusting the moving speed of the carriage 5 in such a manner, the advancing direction of the liquid droplets of the ink discharged from the first nozzles 20 is adjusted at each of scanning positions, thereby allowing the liquid droplets of the ink to land on the scattering film 50 on the object W at a predetermined spacing distance (as an example, at a constant spacing distance). As a result, an effect similar to that in the first embodiment can be obtained.

The present disclosure is not limited to or restricted by the respective embodiments, and any change, addition or deletion can be made with respect to the present disclosure, without departing from the spirit of the present disclosure. It is allowable that switching between the first mode and the second mode can be made, for example, automatically by the controller 6. In such a case, the controller 6 may determine, between the measuring processing and the printing processing, as to whether or not a measured value measured in the measuring processing exceeds a reference value which is set previously; in a case that the controller 6 determines that the measured value exceeds the reference value, the controller 6 may perform the printing processing in the first mode, whereas in a case that the controller 6 determines that the measured value does not exceed the reference value, the controller 6 may perform printing on the object W in the second mode.

As described above, the present disclosure has an excellent effect that a satisfactory image quality can be obtained at a low cost, in a case that printing is to be performed, by using a printer, on a surface of an object having a three-dimensional shape, and even that the surface of the object is a mirror finished surface or the object is transparent. Accordingly, it is beneficially to apply the present disclosure widely to image recording apparatuses capable of realizing the significance of this effect.

What is claimed is:

1. A printer comprising:

a carriage configured to move in a scanning direction;

a head configured to move in the scanning direction along with the carriage;

a position sensor including a light-emitter configured to emit a light toward an object, and a light-receiver configured to receive a reflected light which is the light emitted from the light-emitter and reflected off the object, the position sensor being configured to measure a distance between the head and the object with the reflected light; and a controller, wherein the head includes:

a first nozzle from which a first liquid for printing is discharged; and a second nozzle from which a second liquid that is different from the first liquid is discharged, and wherein the controller is configured to execute:

formation of a scattering film, which is made of the second liquid and is configured to scatter the light emitted from the light emitter, on the object by discharging the second liquid from the second nozzle onto the object;

measurement of the distance with the position sensor receiving the light emitted from the light-emitter, irradiated onto and reflected off the scattering film; and adjustment, based on the measured distance, of a discharging condition of discharging the first liquid from the first nozzle, and performing of printing on the object.

2. The printer according to claim 1, wherein the second liquid is configured to scatter the light emitted from the light emitter.

3. The printer according to claim 1, wherein the light emitted from the light emitter is more scattered by the scattering film which is made of the second liquid than the first liquid.

4. The printer according to claim 1, wherein the position sensor is a sensor of a triangulation system, and is configured to measure the distance based on an incident angle of the reflected light with respect to the light-receiver.

5. The printer according to claim 1, wherein the position sensor is arranged on the carriage at an upstream of the second nozzle in one side in the scanning direction, and wherein the controller is configured to control the head to discharge the second liquid from the second nozzle in a case that the carriage is moving in the one side in the scanning direction.

6. The printer according to claim 5, further comprising another position sensor arranged on the carriage such that the second nozzle is located between the position sensor and the another position sensor in the scanning direction, wherein the controller is configured to control the head to discharge the second liquid from the second nozzle in a case that the carriage is moving in the other side in the scanning direction.

7. The printer according to claim 1, wherein the controller is configured to execute the formation of the scattering film, the measurement of the distance, and the performing of the printing with respect to the object repeatedly at each time a reciprocal scanning of the head in the scanning direction is being performed.

8. The printer according to claim 7, wherein in the reciprocal scanning of the head in the scanning direction, the controller is configured to execute the formation of the scattering film and the measurement of the distance during the scanning to a going path of the reciprocal scanning, and to execute the performing of the printing during the scanning to a returning path of the reciprocal scanning.

9. The printer according to claim 7, further comprising a conveyer configured to convey the object in a conveying direction orthogonal to the scanning direction, wherein the second nozzle and the measuring sensor are located on an upstream in the conveying direction with respect to the first nozzle.

10. The printer according to claim 1, wherein the discharging condition incudes a discharge timing at which the first liquid is discharged from the first nozzle.

11. The printer according to claim 1, wherein the discharging condition includes a discharging speed at which the first liquid is discharged from the first nozzle.

12. The printer according to claim 11, wherein the first nozzle includes a plurality of nozzles;

the controller is configured to execute:

division of the plurality of nozzles included in the first nozzle into a plurality of groups in a case that the controller performs the printing, each of the plurality of groups including at least one of the plurality of nozzles, and adjustment of the discharging speed individually for each of the plurality of groups.

13. The printer according to claim 1, wherein the second liquid is a white ink.

* * * * *